United States Patent [19]

Brigham

[11] 4,021,879

[45] May 10, 1977

[54] CONSTANT PERFORMANCE VACUUM CLEANER

[75] Inventor: Robert Norman Brigham, Monroe, Conn.

[73] Assignee: Consolidated Foods Corporation, Old Greenwich, Conn.

[22] Filed: Nov. 28, 1975

[21] Appl. No.: 636,206

[52] U.S. Cl. ..... 15/319; 55/210

[51] Int. Cl.[2] ..... A47L 5/00

[58] Field of Search ..... 15/319, 327 R, 377; 55/210; 318/480, 640; 417/42, 43

[56] References Cited

UNITED STATES PATENTS

| | | | |
|---|---|---|---|
| 1,904,973 | 4/1933 | Smellie | 15/319 |
| 3,501,899 | 3/1970 | Allen | 417/43 X |
| 3,518,814 | 7/1970 | Maynard | 417/43 X |
| 3,577,869 | 5/1971 | Hosokawa et al. | 15/319 X |

*Primary Examiner*—Christopher K. Moore
*Attorney, Agent, or Firm*—William S. Henry

[57] ABSTRACT

In accordance with the present invention, there is provided control means in a vacuum cleaner for automatically maintaining a substantially constant volumetric air flow within the limits of the capabilities of the system, under varying conditions of resistance to flow occurring any place in the line of flow from the suction nozzle to the inlet to the fan. A further feature is the provision, as part of the control means, of an electric circuit which may be employed also to start and stop, by means of a switch on the hose handle, both the main fan motor and a motor for driving a brush in the nozzle.

9 Claims, 4 Drawing Figures

FIG. 3
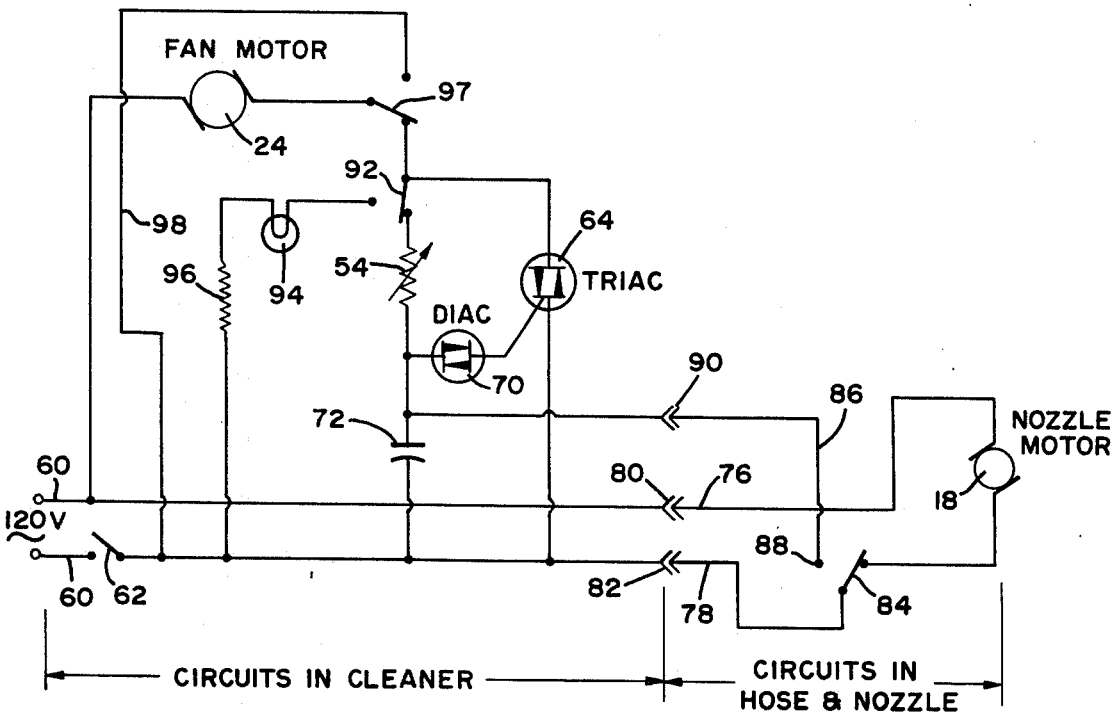
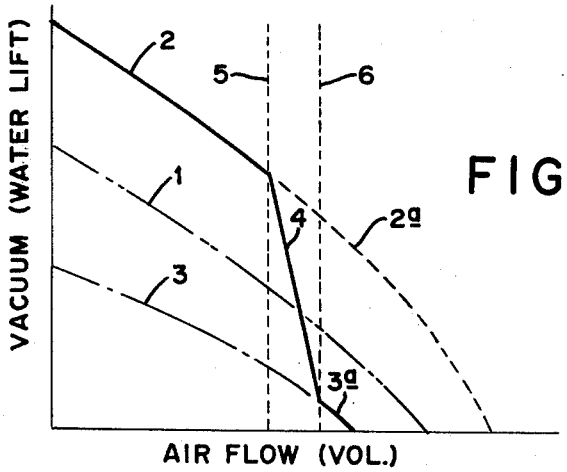
FIG. 4
CONSTANT PERFORMANCE CLEANER
MAX. MOTOR SPEED PERFORMANCE
CONVENTIONAL CLEANER PERFORMANCE
MIN. MOTOR SPEED PERFORMANCE

CONSTANT PERFORMANCE VACUUM CLEANER

BACKGROUND OF THE INVENTION

Heretofore, various arrangements have been proposed for automatically changing the speed of a two-speed fan motor in a vacuum cleaner in response to certain varying conditions, but none has provided an automatic control which results in a substantially constant air flow under all conditions within, of course, the limits of the capabilities of the system. Thus, in U.S. Pat. No. 2,789,660 of Apr. 23, 1952, there is disclosed an arrangement whereby the speed of a two-speed fan motor is increased in a single step in response to a predetermined increase in pressure drop of air through the dust bag, but the control in this patent is not responsive to change in air flow conditions at other points in the system, such as at the nozzle. In U.S. Pat. No. 3,069,068 of Dec. 18, 1962, there is disclosed a vacuum cleaner having a two-speed fan motor, the speed of which is increased in a single step in response to a predetermined increase in pressure difference across the fan. In neither of these patents is the system described capable of maintaining a substantially constant air flow by utilizing a pressure variation within the vacuum cleaner system and atmospheric pressure.

SUMMARY OF THE INVENTION

The invention involves a vacuum cleaner system (i.e., cleaner hose wands and nozzle) provided with automatic controls tending to maintain a substantially constant air flow under varying conditions which occur during normal operation of the cleaner, and in particular to provide a constant flow of air through the cleaner nozzle engaging the surface to be cleaned.

DESCRIPTION OF THE FIGURES

FIG. 3 is a wiring diagram of a suitable electric circuit for automatically controlling the fan motor of FIG. 1 and for manually starting and stopping said fan motor and a nozzle motor by means of a switch located on the vacuum cleaner hose.

FIG. 4 is a graph of static pressure at the end of the hose measured in height of water lift plotted against air flow measured in quantity of air per unit of time, the curves showing vacuum cleaner performances.

Figure 1:
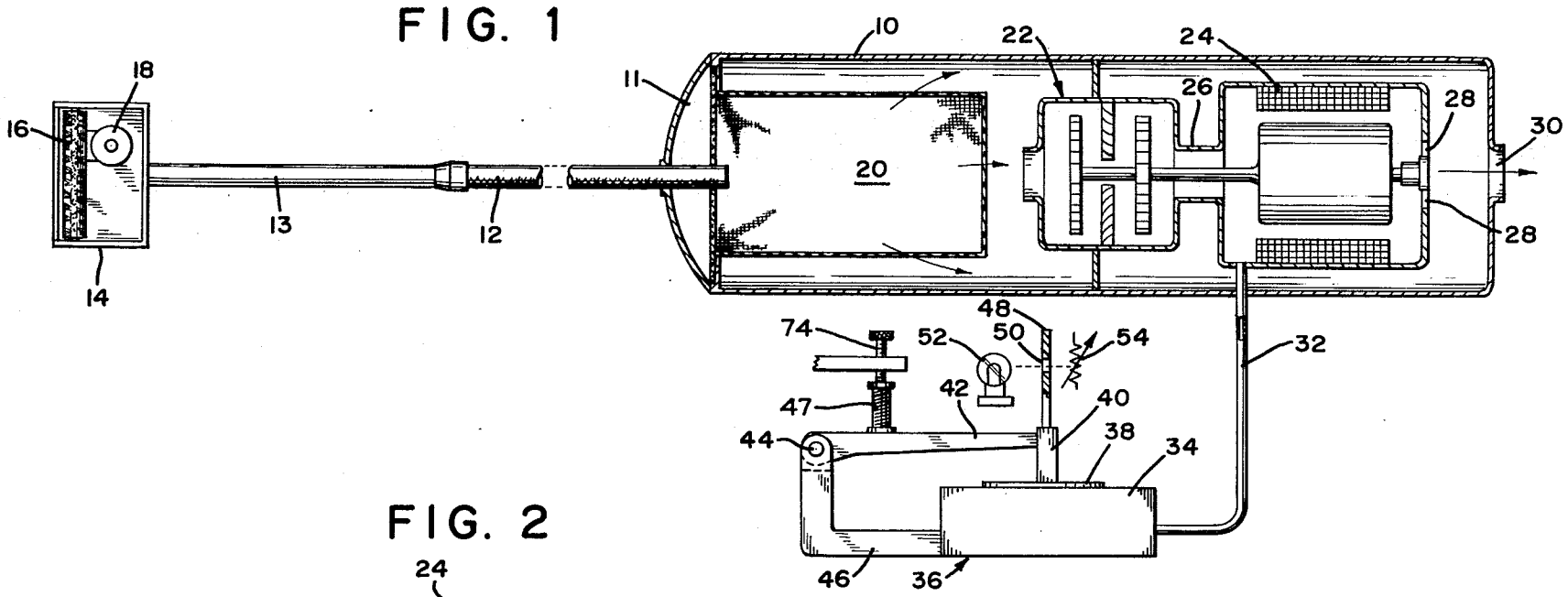
FIG. 1 is a schematic view of a vacuum cleaner system embodying my invention.

Referring to the drawings and particularly to FIG. 1, reference character 10 designates a vacuum cleaner housing at one end of which is a removable cover 11 to which is removably connected a hose 12 leading from a hollow handle 13 of a suction nozzle 14. This nozzle includes a rotary brush 16 driven by an electric motor 18 which, in well known manner, is supplied with power through conductors (not shown) built into hose 12 and the handle or wand 13.

Within housing 10 adjacent to cover 11 is a removable filter bag made of a material permeable with respect to air which serves to filter out and collect dust carried by air entering the bag through hose 12. Also within the housing and adjacent to bag 20 is a centrifugal fan 22 driven by an electric motor 24. The outlet 26 of the fan is connected to the interior of the housing of motor 24 so that all of the air passes through the motor for cooling the armature and field, and is discharged through openings 28 in the motor housing to the interior of housing 10 adjacent to an outlet opening 30 through which the air is discharged to atmosphere. The air passages through motor 24 constitute a substantially fixed orifice for throttling air between the outlet 26 of the fan and atmosphere.

A tube 32 leads from the interior of the motor housing at a point adjacent to outlet 26 and ahead of the fixed orifice to a diaphragm chamber 34 of a pressure transducer 36. One side of chamber 34 is closed by a diaphragm 38, the other exterior side of which is subject to atmospheric pressure. Bearing against the outer side of the diaphragm 38 is a post 40 mounted on the end of an arm 42 pivoted at 44 to a fixed arm 46. A spring 47 urges arm 42 in a direction causing post 40 to bear against the diaphragm 38. Mounted on post 40 is a shutter 48 having an aperture 50. A light source 52 is disposed on one side of the shutter, and a photoresistor cell 54 is located on the other so that more or less light from source 56 may pass through aperture 50 to cell 54 depending on the position of shutter 48 as determined by diaphragm 38.

Figure 2:
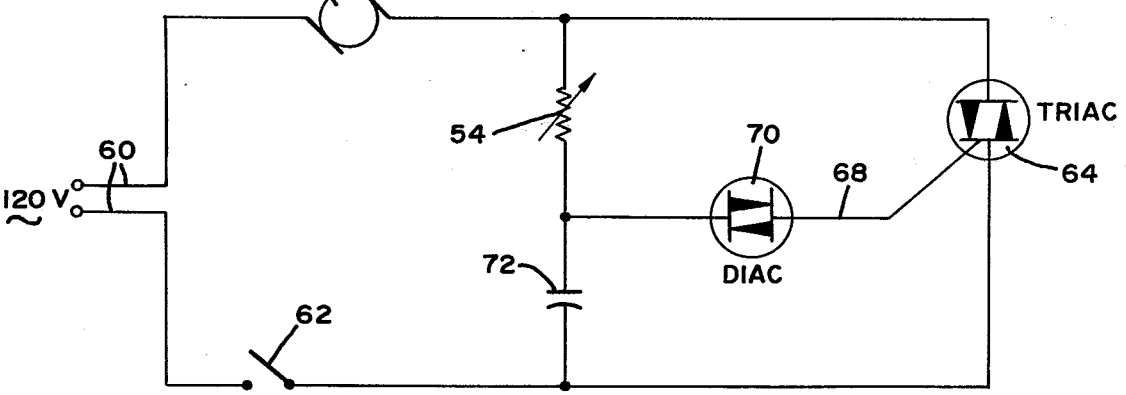
FIG. 2 is a wiring diagram of a suitable electric circuit for automatically controlling the fan motor shown in FIG. 1.

In FIG. 2 there is shown a suitable electric circuit for varying the speed of fan motor 24 in accordance with pressure variations of air measured between the outlet 26 of fan 22 and the constant orifice provided by the air passages through the motor. As here shown, the fan motor 24 is supplied with current from the 120 volt alternating current line 60 through a manual on-off switch 62 and a triac 64. As is well known, the triac controls the flow of current therethrough by interrupting flow during a portion of each cycle of the alternating current, the extent of the portion being controlled by an impulse from a gate circuit 68, including a diac 70, a capacitor 72 and the photoresistor cell 54.

The resistance of cell 54 is decreased by an increase in the illumination reaching it from the light source 52 through the aperture 50 of shutter 48 and a decrease in resistance causes the gate circuit to decrease the portion of the cycle which is interrupted by triac 64, thus increasing the speed of motor 34. Shutter 48 is so arranged with respect to light source 52 and cell 54 that when diaphragm 38 is at rest, that is, subjected to atmospheric pressure on both sides and the force of spring 47, the aperture 50 is positioned to permit maximum illumination of cell 54, while downward or upward a displacement of the diaphragm causes the shutter to reduce the illumination reaching the cell 54.

The above device operates as follows: Assume that the filter bag 20 is clean and hence offers minimum resistance to flow of air therethrough and that the nozzle 14 is on a rug or carpet having an open weave which offers low resistance to flow of air into the nozzle and that switch 62 is closed. Under these conditions of low resistance to flow through the system, the fan 22 has a large volume of air available to move and hence discharges a large volume through outlet 26 into the motor housing. Because of the fixed orifice provided by the passages through motor 24, this causes a relatively high pressure to exist at outlet 26, which is communicated through tube 37 to diaphragm chamber 34 and displaces the diaphragm 38 upwardly against atmospheric force acting on the outer side of the diaphragm and the force of spring 47. This in turn moves shutter 48 upwardly so as to decrease the illumination of cell 54, which increases the resistance of the cell 54 so as to cause triac 64 to decrease the motor speed, which is desired as a slower fan speed is sufficient to move the desired constant volume of air through the system because of low resistance to flow into the nozzle and through the filter bag.

If the resistance to flow of air into the nozzle is increased, as by placing the nozzle on a carpet of tighter weave, the volume of air moved by fan 22 is decreased and the pressure transmitted by tube 32 is decreased. This causes diaphragm 38 to move downwardly to in turn increase the illumination of cell 54, which increases motor speed, which is desirable in order to maintain constant air flow in spite of the increased resistance of flow into the nozzle.

As filter bag 20 fills with dirt and becomes more clogged, the resistance to the flow of air therethrough increases, and this has the same effect as increasing the resistance to flow into the nozzle as described above. Thus, motor 24 is speeded up to enable the fan 22 to maintain a constant flow of air as the filter bag fills or becomes clogged with dust.

Thus, the motor speed is automatically controlled in a manner causing the fan to maintain a substantially constant volumetric flow of air through the system under variations in the resistance to flow of air occurring at any point between the nozzle and the fan. Of course, should the nozzle inlet be completely sealed so that no air may enter, it is impossible for the fan, no matter what its capacity is, to move any air through the system, but the fan would be rotating at its greatest speed.

FIG. 4 is a graph showing negative air pressure (vacuum) in the system at the suction side of the fan, measured, for instance, in inches of water lift, plotted against the volume of air flow. Curve 1 is for a typical vacuum cleaner without controls. Thus, at sealed suction, the vacuum is the maximum which the fan is capable of producing and the quantity of air flowing is zero. If the resistance to air flow through the system is reduced, the vacuum falls and the quantity of air increases until, at the lower end of curve 1, the quantity of air is the maximum which the fan is capable of moving, and the vacuum (water-lift) is very low.

Under curve 2, 2*a* shows the performance of the motor-fan unit of the vacuum cleaner in accordance with the present invention if operated without controls, that is, with the motor 24 operating at full speed at all times. It will be seen that it is similar to curve 1, except that the performance is higher at all times, which is higher than desirable under certain conditions, as will appear below.

Lower curve 3, 3*a* shows the performance of the motor fan unit 22–24 if the motor is operated at all times at the minimum speed obtainable by the controls in accordance with the present invention. It likewise is similar to curve 1, except that the performance is lower at all times, which is lower than desirable under certain other conditions.

The solid line curve, made up of curves 2, 3*a* and a very steep connecting curve 4, represents the performance of the vacuum cleaner in accordance with the present invention, curve 4 showing the relationship between vacuum (water-lift) and air flow within the limits, represented by the vertical broken lines 5 and 6, of the capabilities of the system. Within these limits (between lines 5 and 6) it will be seen that there is very little variation in air flow over a relatively large change in vacuum, and this variation in air flow (distance between lines 5 and 6) depends on the sensitivity of pressure transducer 36. Obviously, some change in pressure of the air acting on diaphragm 38 is necessary in order to cause movement thereof.

The horizontal location of the lines 5 and 6 in FIG. 4, i.e., air flow value, may be changed by changing the characteristics of the control system, such as by altering the force exerted by spring 47 by changing the setting of a setscrew 74 against which the spring bears. Decreasing the force of this spring moves the lines 5 and 6 to the left, and increasing the force moves the lines to the right.

Should the resistance to air flow be increased so as to reduce the air flow below the value represented by the upper end of curve 4, the relationship between vacuum and air flow follows the curve 2 until maximum vacuum is attained at sealed suction, that is, zero air flow. Likewise, if resistance to air flow is greatly reduced, as by removing cover 11 and filter bag 20, thus increasing the flow beyond the value represented by the lower end of curve 4, the relationship between vacuum and air flow follows the curve 3*a* until maximum air flow is reached.

With a vacuum cleaner as shown in FIG. 1, it is desirable for the operator to be able to start and stop the fan motor 24 by means of a switch located near the end of hose 12 where the latter is connected to handle 13 of nozzle 14, and the circuit shown in FIG. 2 may be adapted to this purpose in the manner illustrated in FIG. 3. In FIG. 3 the elements common to FIG. 2 are designated by the same reference characters. The conductors in hose 12 which supply current to nozzle motor 18 are numbered 76 and 78 and are connected through separable contacts 80 and 82, respectively, with the 120 v. line 60 in the cleaner housing 10. A single pole, double-throw switch 84 is provided in conductor 78 and is located on hose 12 near its juncture with handle 13 of the nozzle. In the position of switch 84 as shown in FIG. 3, the circuit is completed to motor 18, and if main switch 62 is closed, current is supplied directly to motor 18, and to fan motor 24 through the control circuit including triac 64, as explained in connection with FIG. 2. In addition to the power conductors 76 and 78, there is a small gauge control conductor 86 which is connected to pole 88 of switch 84 and through a separable contact 90 with the conductor leading from capacitor 72 to diac 70. When switch 84 is thrown to close the circuit through pole 88, it interrupts the supply of current to nozzle motor 18 and closes a shunt circuit around capacitor 72. This renders gate circuit 68 inoperative to trigger triac 64, and hence no current is transmitted therethrough to fan motor 24.

The wiring diagram of FIG. 3 also includes a single pole double-throw switch 92 which is operated in well-known manner (see U.S. Pat. No. 2,814,358 of Nov. 26, 1957) in response to pressure drop through filter bag 20 to automatically throw the switch from the position shown when this pressure drop, which is an indication of the clogging of the bag, reaches a value such that the bag should be removed and replaced by a clean one. Throwing of the switch 92 opens the control for the gate circuit, and hence triac 64 is not triggered and does not permit the passage of current therethrough to motor 24. At the same time switch 92 completes a circuit across line 60 through motor 24, a signal lamp 94 and a high resistance 96. The latter limits the flow of current through this circuit to a value below that required to operate motor 24 but sufficient to light lamp 94, thus indicating to the operator that motor 24 has stopped because of a dirty filter bag, and not because of an extraneous loss of power caused, for instance, by a blown fuse or circuit breaker in the house circuit or by an inadvertent removal of a plug from a wall outlet.

If the vacuum cleaner is operated without the hose 12 being connected to front cover 11, as is the case when the cleaner is used for blowing by connecting the hose to outlet 30, the circuits are opened at the separable contacts 80, 82 and 90. Under these conditions the circuit in the cleaner for controlling the speed of motor 24 will operate as above described, but, of course, the operator cannot stop motor 24 by manipulating switch 84, but only by opening main switch 62. When the cleaner is used for blowing, the air flow to the fan inlet encounters a minimum restriction. The control then would act to reduce the air flow to the curve 3*a* for minimum motor speed performance. To provide maximum performance for blowing operation, a single-pole double-throw switch 97 is mechanically activated when the hose is connected to the exhaust opening 30 to connect the motor directly through a conductor 98 to switch 62, thus bypassing the motor control and providing full power to the motor. When the hose is disconnected from the exhaust opening, the switch 97 is returned to normal position and the motor is controlled as described previously.

It will thus be seen that I have provided a system which, within the limits of its capabilities, automatically maintains a substantially constant flow of air through a vacuum cleaner regardless of wide variations in the resistance to air flow occuring at any point in the cleaner on the suction side of the blower.

What I claim is:

1. In a vacuum cleaner, a housing having an intake opening and an exhaust opening to atmosphere, a dust filter within said housing between said openings, means for introducing dust-ladened air into said housing through said intake opening to one side of said filter, air moving means within said housing having an inlet communicating with the other side of said filter and an outlet communicating with said exhaust opening, a motor for driving said air-moving means, a fixed orifice disposed across the path of airflow in said housing between said outlet and said exhaust opening to atmosphere, and means responsive to variations in air pressure occurring in the path of airflow between said outlet and said orifice for varying the speed of said motor in a manner to maintain substantially constant the volume of air per unit of time flowing through said housing.

2. The combination as set forth in claim 1 in which said motor is an electric motor having a housing connected to receive the air discharged through said outlet, the passages through said motor constituting said fixed orifice.

3. The combination as set forth in claim 1, in which said motor is an electric motor, and said means responsive to variations in air pressure includes a triac in the circuit of said motor, a triggering circuit for said triac including a diac and a variable electric resistance, and means including a diaphragm acted on by said variations in air pressure for varying said resistance.

4. The combination as set forth in claim 3 in which said variable resistance is a photoresistor cell, and including a source of illumination and a shutter movable by said diaphragm for varying the amount of illumination received by said cell from said source.

5. The combination as set forth in claim 4 in which the first mentioned means is a hose removably connected to said housing and including a suction nozzle connected to said hose, an electric motor in said nozzle, a pair of electric conductors in said hose for supplying current to the last mentioned motor, a switch on said hose in one of said conductors having one position for interrupting said conductor and completing a circuit through a third conductor in said hose for shunting a portion of said triggering circuit to render the latter inoperative.

6. The combination as set forth in claim 3, including a switch for bypassing said triac to cause said motor to run at full speed.

7. In a vacuum cleaner system, a suction nozzle, a conduit connected at one end to said nozzle, a hollow body connected to the other end of said conduit, a suction fan in said body having an inlet and an outlet, a dust filter in said body in the line of flow between said conduit and said inlet, an electric motor for driving said fan, said motor having air passage therethrough constituting a fixed orifice, means for directing all of the air discharged from said outlet to pass through said orifice, a diaphragm subjected on one side to atmospheric pressure, means for subjecting the other side of said diaphragm to the air pressure existing in said hollow body between said outlet and said orifice, and means responsive to movement of said diaphragm caused by a decrease in said pressure for increasing the speed of said motor to maintain substantially constant airflow through said nozzle.

8. A vacuum cleaner system as defined in claim 7, in which the last-mentioned means includes a triac in the circuit of said motor for varying the speed of the latter, a triggering circuit for said triac including a diac and a variable resistance, and means for varying said resistance in response to movement of said diaphragm.

9. A vacuum cleaner system as defined in claim 8 in which said variable resistance is a photoresistor cell, and including a source of illumination and an apertured shutter movable by said diaphragm for varying the amount of illumination received by said cell from said source in accordance with variations in said pressure.

* * * * *

UNITED STATES PATENT OFFICE

CERTIFICATE OF CORRECTION

Patent No. 4,021,879 Dated May 10, 1977

Inventor(s) Robert Norman Brigham

It is certified that error appears in the above-identified patent and that said Letters Patent are hereby corrected as shown below:

On the Title Page, Item [75] should read:

-- Robert Norman Brigham, Monroe, Conn.
James W. Momberg, Stamford Conn. --.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*